US007870772B1

(12) United States Patent
Guo et al.

(10) Patent No.: US 7,870,772 B1
(45) Date of Patent: Jan. 18, 2011

(54) EXTERIOR LEVER LOCK DEVICE WITH A CLUTCH ASSEMBLY

(75) Inventors: Ming-Ying Guo, Tianjin (CN); Xiu-Feng Liu, Tianjin (CN)

(73) Assignee: Eversafety Precision Industry (Tianjin) Co., Ltd (CN)

( * ) Notice: Subject to any disclaimer, the term of this patent is extended or adjusted under 35 U.S.C. 154(b) by 0 days.

(21) Appl. No.: 12/560,407

(22) Filed: Sep. 15, 2009

(51) Int. Cl.
*E05B 13/10* (2006.01)

(52) U.S. Cl. ..... 70/472; 70/223; 70/224; 70/DIG. 42; 292/DIG. 27

(58) Field of Classification Search ..... 70/422, 70/472, 149, 215–218, 221–224, 188, 189, 70/DIG. 42; 292/DIG. 27
See application file for complete search history.

(56) References Cited

U.S. PATENT DOCUMENTS

| | | | | | |
|---|---|---|---|---|---|
| 1,855,697 | A * | 4/1932 | Sullivan | 70/223 |
| 2,055,289 | A * | 9/1936 | Hanan | 70/240 |
| 2,998,274 | A * | 8/1961 | Russell | 292/169.17 |
| 5,794,472 | A * | 8/1998 | Kester et al. | 70/472 |
| 5,809,815 | A * | 9/1998 | Lee | 70/472 |
| 5,904,232 | A * | 5/1999 | Shen | 192/69.62 |
| 5,934,117 | A * | 8/1999 | Shen | 70/224 |
| 6,189,351 | B1 * | 2/2001 | Eagan et al. | 70/472 |
| 6,412,318 | B1 * | 7/2002 | Shen | 70/217 |
| 6,470,721 | B2 * | 10/2002 | Ming | 70/224 |
| 6,807,834 | B2 * | 10/2004 | Tsai | 70/472 |
| 7,100,407 | B2 * | 9/2006 | Chen | 70/224 |
| 2004/0031300 | A1 * | 2/2004 | Wu | 70/223 |
| 2004/0074269 | A1 * | 4/2004 | Lee | 70/224 |
| 2004/0237608 | A1 * | 12/2004 | Chen | 70/224 |
| 2006/0185409 | A1 * | 8/2006 | Sun et al. | 70/224 |
| 2008/0216528 | A1 * | 9/2008 | Sun et al. | 70/224 |
| 2009/0025438 | A1 * | 1/2009 | Don et al. | 70/224 |

* cited by examiner

*Primary Examiner*—Lloyd A Gall
(74) *Attorney, Agent, or Firm*—Hershkovitz & Associates, LLC; Abraham Hershkovitz

(57) ABSTRACT

An exterior lever lock device with a clutch assembly is mounted on a door, is connected to a bolt and an indoor lever lock device and has a lever assembly, a driving assembly, a clutch assembly and a driven assembly. The driven assembly has an inner sleeve and a locking panel fastened to the clutch assembly and selectively engaging the inner sleeve. Therefore, whenever the lever lock is locked or unlocked, as long as there is a turning force applied to the lever assembly, the lever assembly turns and is not broken easily. An endurance of the exterior lever lock device is prolonged for improved lock performance.

18 Claims, 6 Drawing Sheets

EXTERIOR LEVER LOCK DEVICE WITH A CLUTCH ASSEMBLY

BACKGROUND OF THE INVENTION

1. Field of the Invention

The present invention relates to an exterior lever lock device with a clutch assembly, especially to an exterior lever lock device that whenever the lever lock is locked or unlocked, an exterior lever of the exterior lever lock device still turns.

2. Description of the Prior Art(s)

A conventional lever lock is mounted on a door and has a bolt, an indoor lever lock device and an exterior lever lock device. The bolt is mounted in the door. The indoor lever lock device is mounted on an inside surface of the door, is connected to the bolt and has an indoor lever and a switch control, such as a push button, a turn button or the like, mounted in the indoor lever. The exterior lever lock device is mounted on an outside surface of the door, is connected to the door to selectively lock or unlock the door and has an exterior lever and a lock cylinder mounted in the exterior lever.

As a person inside the house turns the switch control to lock the door, the exterior lever is fixed horizontally and is unable to be turned to unlock the door to prevent the door from being opened from outside of the house. When a key is inserted into and unlocks the lock cylinder of the exterior lever lock device, the exterior lever is turned to open the door.

However, when the exterior lever is fixed horizontally, turning force applied to the exterior lever breaks the exterior lever easily. Therefore, the conventional lever lock does not protect articles or people inside the house efficiently and practically since articles inside the house are still in danger of being stolen and the people are also in danger.

To overcome the shortcomings, the present invention provides an exterior lever lock device with a clutch assembly to mitigate or obviate the aforementioned problems.

SUMMARY OF THE INVENTION

The main objective of the present invention is to provide an exterior lever lock device with a clutch assembly. The exterior lever lock device is mounted on a door, is connected to a bolt and an indoor lever lock device and has a lever assembly, a driving assembly, a clutch assembly and a driven assembly. The driven assembly has an inner sleeve and a locking panel fastened to the clutch assembly and selectively engaging the inner sleeve.

Therefore, whenever the lever lock is locked or unlocked, as long as there is a turning force applied to the lever assembly, the lever assembly turns with the turning force and is not broken easily. An endurance of the exterior lever lock device is prolonged for improved lock performance.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
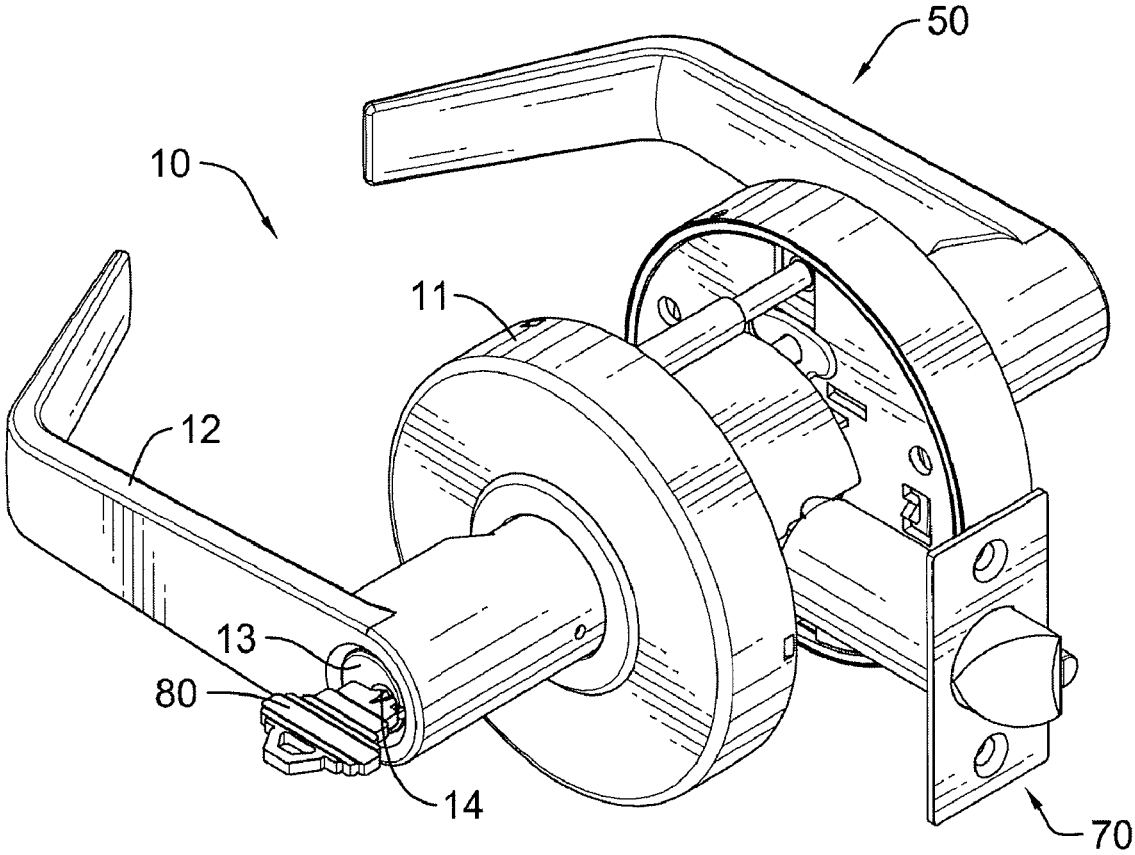
FIG. 1 is an operational perspective view of a lever lock having an exterior lever lock device with a clutch assembly in accordance with the present invention.
Figure 2:
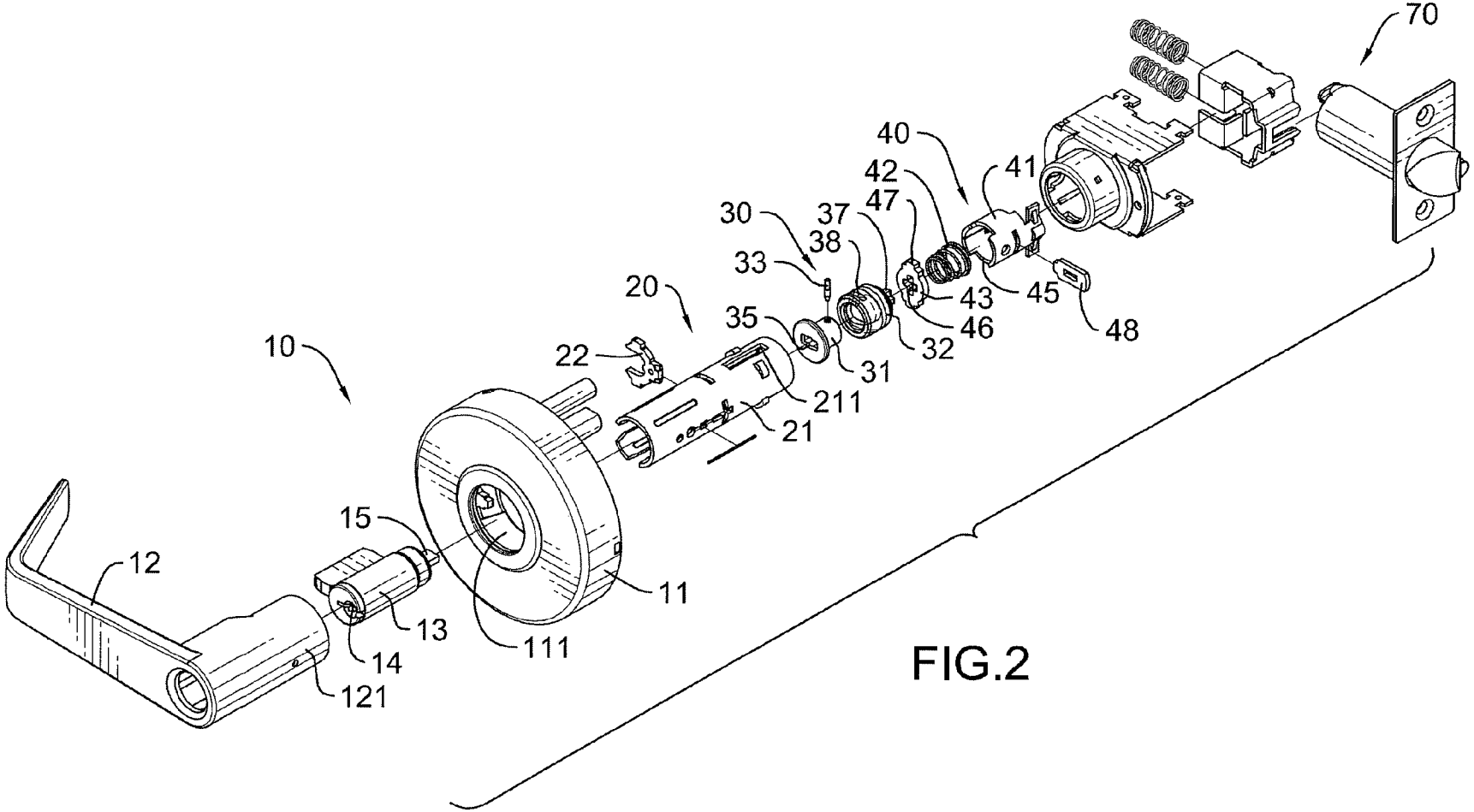
FIG. 2 is an exploded perspective view of the exterior lever lock device in FIG. 1.
Figure 6:
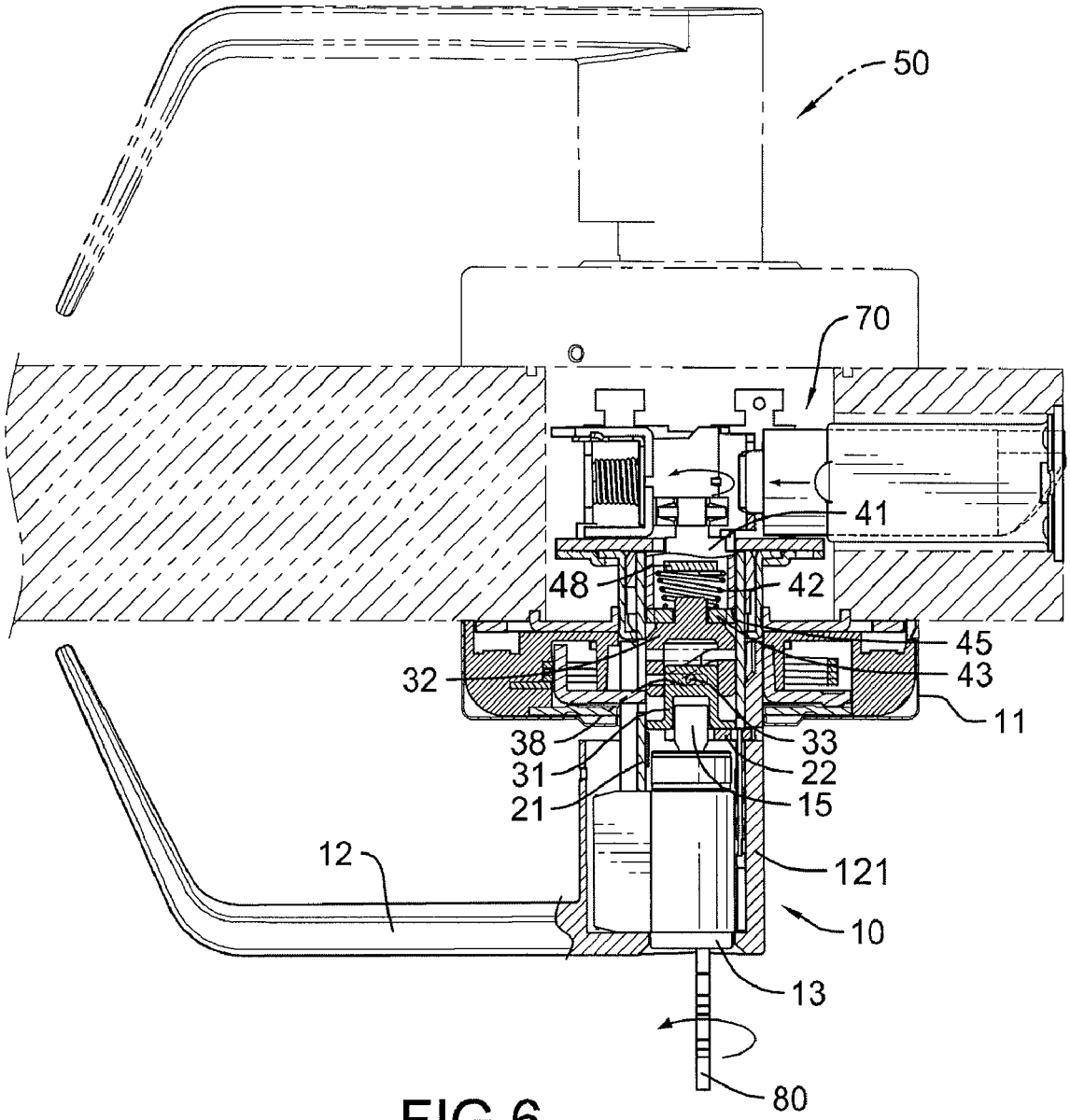
FIG. 6 is an operational top view in partial section of the lever lock in FIG. 1, shown locked.

With reference to FIGS. 1, 2 and 6, a lever lock is mounted through a door and comprises a bolt (70), an indoor lever lock device (50) and an exterior lever lock device in accordance with the present invention. The bolt (70) is mounted in the door and selectively locks the door. The indoor lever lock device (50) is mounted on an inside surface of the door and is connected to the bolt (70). The exterior lever lock device is mounted on an outside surface of the door, is connected to the bolt (70) and comprises a lever assembly (10), a driving assembly (20), a clutch assembly (30) and a driven assembly (40).

The lever assembly (10) has an exterior cap (11), an exterior lever (12) and a lock cylinder (13). The exterior cap (11) is mounted on the outside surface of the door and has a mounting hole (111). The mounting hole (111) is formed through the exterior cap (11). The exterior lever (12) is mounted on an outer surface of the exterior cap (11) and has a mounting tube (121). The mounting tube (121) protrudes transversely from a mounting end of the exterior lever (12) and is concentric with the mounting hole (111) of the exterior cap (11). The lock cylinder (13) is mounted securely in the mounting tube (121) of the exterior lever (12) and has a key mount (14) and a driving shaft (15). The key mount (14) is formed in an outer end of the lock cylinder (13). The driving shaft (15) protrudes coaxially from an inner end of the lock cylinder (13).

The driving assembly (20) is mounted between the mounting hole (111) of the exterior cap (11) and the mounting tube (121) of the exterior lever (12) and has an outer sleeve (21) and a latch panel (22). The outer sleeve (21) is mounted through the mounting hole (111) of the exterior cap (11), protrudes into the mounting tube (121) of the exterior lever (12), is mounted securely around the lock cylinder (13) and has and at least one guiding slot (211). The at least one guiding slot (211) is formed through a sidewall of the outer sleeve (21). The latch panel (22) is radially mounted securely through the outer sleeve (21) and holds the driving shaft (15) of the lock cylinder (13).

Figure 3:
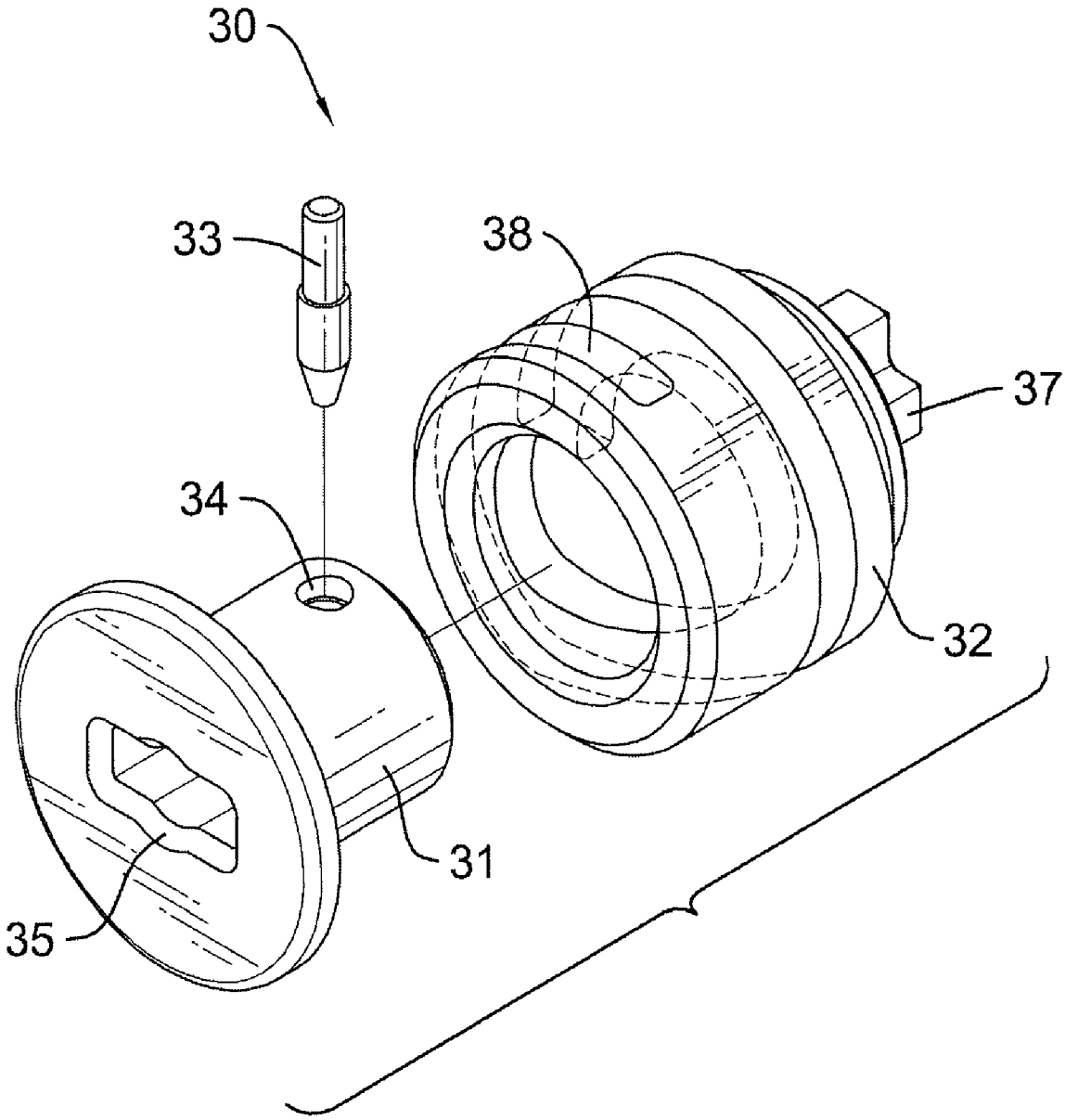
FIG. 3 is an enlarged exploded perspective view of a clutch assembly of the exterior lever lock device in FIG. 1.
Figure 4:
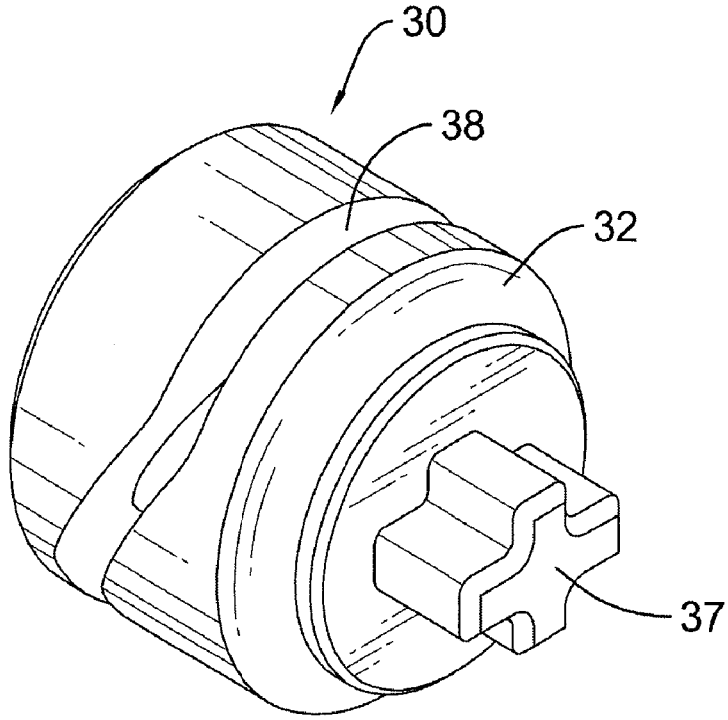
FIG. 4 is another perspective view of the clutch assembly of the exterior device in FIG. 1.
Figure 5:
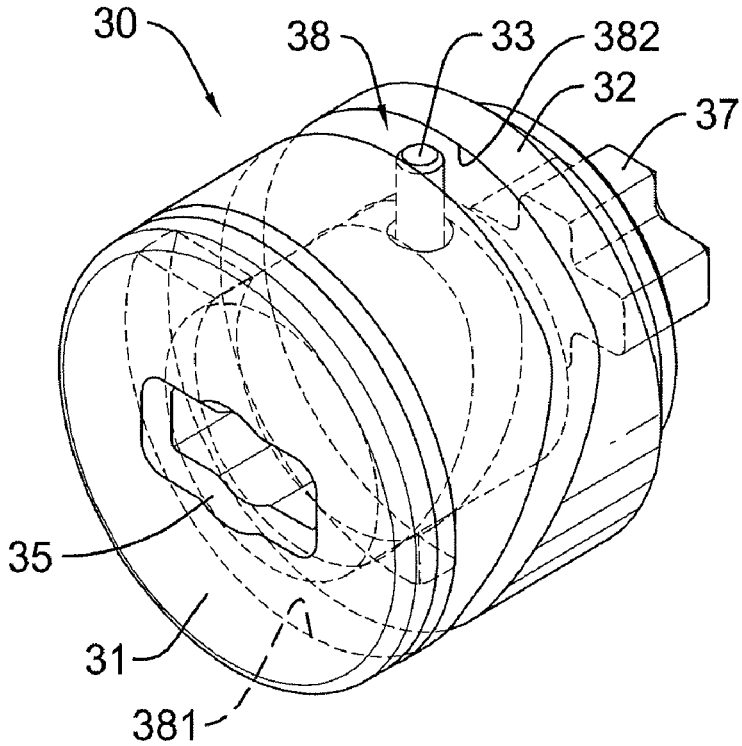
FIG. 5 is a transparent perspective view of the clutch assembly of the exterior lever lock device in FIG. 1.

With further reference to FIGS. 3 to 5, the clutch assembly (30) is mounted in the outer sleeve (21) and has a core bracket (31), a driving tube (32) and a guiding rod (33).

The core bracket (31) has a connecting end and a slot (35). The connecting end of the core bracket (31) is connected to the lock cylinder (13) and abuts the latch panel (22). The slot (35) is formed centrally in the connecting end of the core bracket (31) and is connected to the driving shaft (15) of the lock cylinder (13).

The driving tube (32) is mounted around the core bracket (31) and has an open end, a closed end, an engaging protrusion (37) and a guiding groove (38). The engaging protrusion (37) is formed on the closed end of the driving tube (32) and is shaped as a cross. The guiding groove (38) is formed through a sidewall of the driving tube (32), may be spiral and has an engaging portion (381) and a disengaging portion (382). The engaging portion (381) of the guiding groove (38)

corresponds to the open end of the driving tube (32). The disengaging portion (382) of the guiding groove (38) corresponds to the closed end of the driving tube (32).

The guiding rod (33) is mounted through the guiding groove (38) of the driving tube (32) and is attached securely to the core bracket (31).

The driven assembly (40) is mounted in the outer sleeve (21), is connected to the clutch assembly (30) and the bolt (70) and has an inner sleeve (41), a stop panel (48), a resilient element (42) and a locking panel (43).

The inner sleeve (41) has a connecting end, a mounting end, a peripheral edge and at least one locking indentation (45). The connecting end of the inner sleeve (41) is connected to the bolt (70). The mounting end of the inner sleeve (41) corresponds to the clutch assembly (30). The peripheral edge of the inner sleeve (41) is formed around the mounting end of the inner sleeve (41). The at least one locking indentation (45) is formed in the peripheral edge of the inner sleeve (41).

The stop panel (48) is mounted radially through a sidewall of the inner sleeve (41).

The resilient element (42) is mounted in the inner sleeve (41) and may be mounted between the mounting end of the inner sleeve (41) and the stop panel (48).

The locking panel (43) is fastened to the closed end of the driving tube (32), is mounted on the mounting end of the inner sleeve (41), abuts the resilient element (42), selectively engages the inner sleeve (41) and has a peripheral edge, an engaging hole (46) and at least one locking protrusion (47). The engaging hole (46) is formed through the locking panel (43), engages the engaging protrusion (37) of the driving tube (32) and is shaped as a cross. The at least one locking protrusion (46) is formed radially on the peripheral edge of the locking panel (43), is mounted in and slidable along the at least one guiding slot (211) of the outer sleeve (21) and selectively engages the at least one locking indentation (45) of the inner sleeve (41).

Thus, when a key (80) is inserted into the key mount (14) and turns the driving shaft (15) of the lock cylinder (13), the core bracket (31) rotates together with the driving shaft (13). Then the guiding rod (33) slides along the guiding groove (38) of the driving tube (32) and moves the driving tube (32) and the locking panel (43) to allow the at least one locking protrusion (46) of the locking panel (43) to selectively engaging the at least one locking indentation (45) of the inner sleeve (41).

Figure 7:
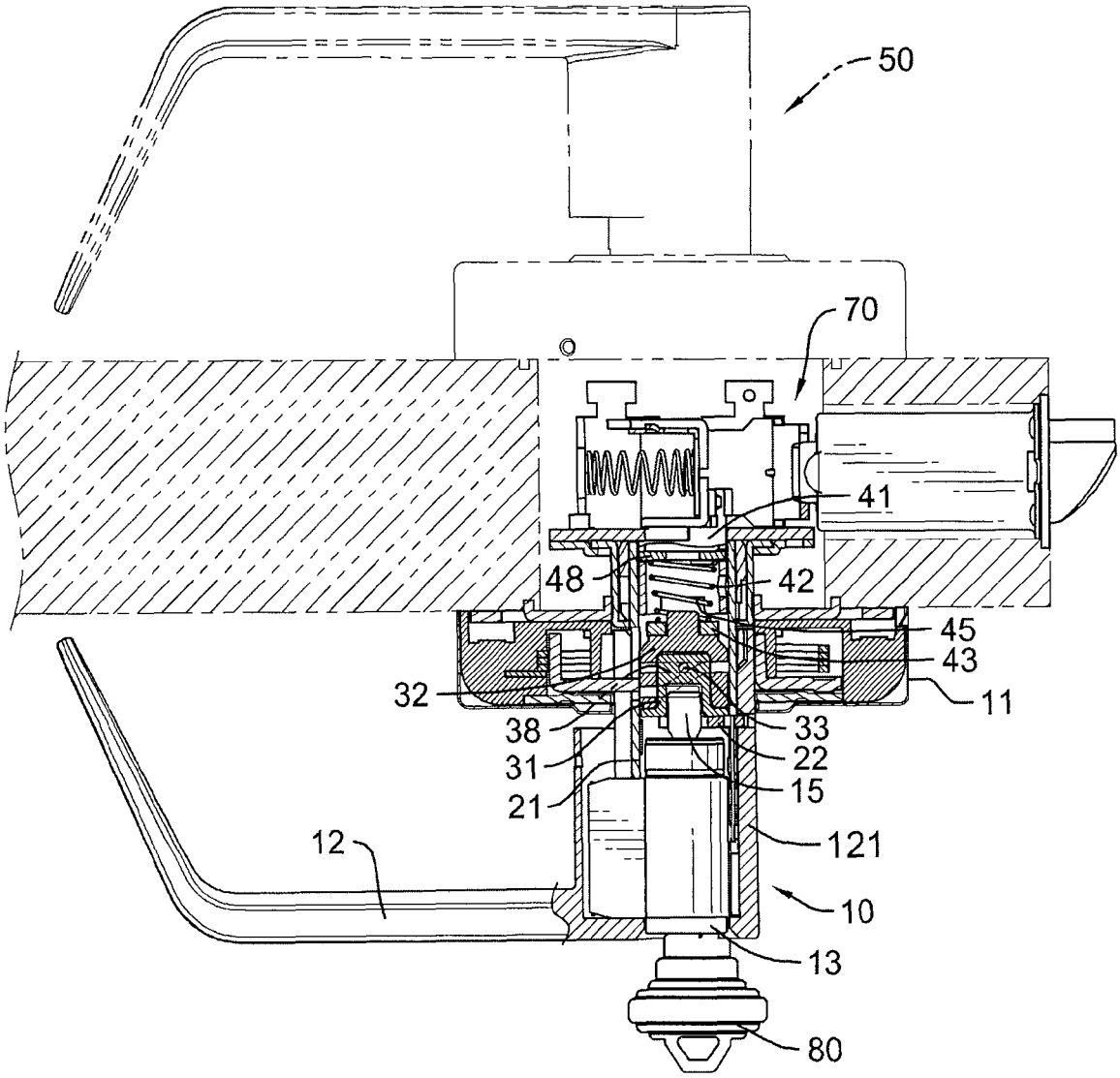
FIG. 7 is another operational top view in partial section of the lever lock in FIG. 1, shown unlocked.

With further reference to FIG. 7, when the lever lock is locked, the guiding rod (33) is disposed in the disengaging portion (382) of the guiding groove (38) of the driving tube (32) and the resilient element (42) pushes the locking panel (43) to disengage the locking panel (43) from the inner sleeve (41).

Then, as a turning force is applied to the exterior lever (12), the exterior lever (12), the lock cylinder (13), the outer sleeve (21), the driving tube (33) and the locking panel (43) rotate simultaneously. Since the locking panel (43) disengages from the inner sleeve (41), the inner sleeve (41) does not rotate accordingly. Consequently, the bolt (70) is unable to be unlocked.

With further reference to FIG. 6, when the key (80) is inserted into the key mount (14) of the lock cylinder (13) and turns, the guiding rod (33) slides along the guiding groove (38) of the driving tube (32) toward the engaging portion (381) of the guiding groove (38). Then the driving tube (32) and the locking panel (43) push the resilient element (42) and move toward the inner sleeve (41) to allow the at least one locking protrusion (47) of the locking panel (43) to engage the at least one indentation (45) of the inner sleeve (41). Therefore, as the turning force is applied to the exterior lever (12), the inner sleeve (41) rotates simultaneously and the bolt (70) is unlocked.

Furthermore, when the key (80) turns reversely to slide the guiding rod (33) along the guiding groove (38) of the driving tube (32) and toward the disengaging portion (382) of the guiding groove (38), the resilient element (42) pushes the locking panel (43) to disengage from the inner sleeve (41). Thus, the lever lock is locked again and although the lever lock is locked, the exterior lever (12) still turns.

The exterior lever lock device with a clutch assembly as described has the following advantages. Whenever the lever lock is locked or unlocked, as long as there is a turning force applied to the lever assembly (10), the lever assembly (10) turns with the turning force and is not broken easily. An endurance of the exterior lever lock device is prolonged for improved lock effectiveness.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exterior lever lock device comprising a lever assembly having an exterior cap having a mounting hole formed through the exterior cap;

an exterior lever mounted on an outer surface of the exterior cap and having a mounting tube protruding transversely from a mounting end of the exterior lever and being concentric with the mounting hole of the exterior cap; and a lock cylinder mounted securely in the mounting tube of the exterior lever;

a driving assembly mounted between the mounting hole of the exterior cap and the mounting tube of the exterior lever and having an outer sleeve mounted through the mounting hole of the exterior cap, protruding into the mounting tube of the exterior lever and mounted securely around the lock cylinder;

a clutch assembly mounted in the outer sleeve and having a core bracket having a connecting end connected to the lock cylinder;

a driving tube mounted around the core bracket and having an open end;

a closed end; and a guiding groove formed through a sidewall of the driving tube and having an engaging portion corresponding to the open end of the driving tube; and a disengaging portion corresponding to the closed end of the driving tube; and a guiding rod mounted through the guiding groove of the driving tube and attached securely to the core bracket; and a driven assembly mounted in the outer sleeve, connected to the clutch assembly and having an inner sleeve having a mounting end corresponding to the clutch assembly;

a resilient element mounted in the inner sleeve; and a locking panel fastened to the closed end of the driving tube, mounted on the mounting end of the inner sleeve, abutting the resilient element and selectively engaging the inner sleeve.

2. The exterior lever lock device as claimed in claim 1, wherein the lock cylinder of the lever assembly further has a key mount formed in an outer end of the lock cylinder; and a driving shaft protruding coaxially from an inner end of the lock cylinder; and the core bracket of the clutch assembly further has a slot formed centrally in the connecting end of the core bracket and connected to the driving shaft of the lock cylinder.

3. The exterior lever lock device as claimed in claim 1, wherein the driving assembly further has a latch panel radially mounted securely through the outer sleeve; and the connecting end of the core bracket of the clutch assembly abuts the latch panel.

4. The exterior lever lock device as claimed in claim 2, wherein the driving assembly further has a latch panel radially mounted securely through the outer sleeve and holding the driving shaft of the lock cylinder; and the connecting end of the core bracket of the clutch assembly abuts the latch panel.

5. The exterior lever lock device as claimed in claim 1, wherein the driving tube of the clutch assembly further has an engaging protrusion formed on the closed end of the driving tube and shaped as a cross; and the locking panel of the driven assembly further has an engaging hole formed through the locking panel, engaging the engaging protrusion of the driving tube and shaped as a cross.

6. The exterior lever lock device as claimed in claim 2, wherein the driving tube of the clutch assembly further has an engaging protrusion formed on the closed end of the driving tube and shaped as a cross; and the locking panel of the driven assembly further has an engaging hole formed through the locking panel, engaging the engaging protrusion of the driving tube and shaped as a cross.

7. The exterior lever lock device as claimed in claim 3, wherein the driving tube of the clutch assembly further has an engaging protrusion formed on the closed end of the driving tube and shaped as a cross; and the locking panel of the driven assembly further has an engaging hole formed through the locking panel, engaging the engaging protrusion of the driving tube and shaped as a cross.

8. The exterior lever lock device as claimed in claim 4, wherein the driving tube of the clutch assembly further has an engaging protrusion formed on the closed end of the driving tube and shaped as a cross; and the locking panel of the driven assembly further has an engaging hole formed through the locking panel, engaging the engaging protrusion of the driving tube and shaped as a cross.

9. The exterior lever lock device as claimed in claim 1, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

10. The exterior lever lock device as claimed in claim 2, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

11. The exterior lever lock device as claimed in claim 3, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

12. The exterior lever lock device as claimed in claim 4, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

13. The exterior lever lock device as claimed in claim 5, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

14. The exterior lever lock device as claimed in claim 6, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

15. The exterior lever lock device as claimed in claim 7, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

16. The exterior lever lock device as claimed in claim 8, wherein the outer sleeve of the driving assembly further has at least one guiding slot formed through a sidewall of the outer sleeve;

the inner sleeve of the driven assembly further has a peripheral edge formed around the mounting end of the inner sleeve; and at least one locking indentation formed in the peripheral edge of the inner sleeve; and the locking panel of the driven assembly further has a peripheral edge; and at least one locking protrusion formed radially on the peripheral edge of the locking panel, mounted in and slidable along the at least one guiding slot of the outer sleeve and selectively engaging the at least one locking indentation of the inner sleeve.

17. The exterior lever lock device as claimed in claim 1, wherein the guiding groove of the driving tube of the clutch assembly is spiral.

18. The exterior lever lock device as claimed in claim 1, wherein the driven assembly further has a stop panel mounted radially through a sidewall of the inner sleeve; and the resilient element of the driven assembly is mounted between the mounting end of the inner sleeve and the stop panel.

* * * * *